US006305560B1

(12) United States Patent
Meyer

(10) Patent No.: US 6,305,560 B1
(45) Date of Patent: Oct. 23, 2001

(54) MULTIPLE PEDESTAL RING FOR RINGER CRANE

(76) Inventor: William D. Meyer, 3407 Waters Edge Dr., Sugar Land, TX (US) 77478

( * ) Notice: Subject to any disclaimer, the term of this patent is extended or adjusted under 35 U.S.C. 154(b) by 0 days.

(21) Appl. No.: 09/503,307

(22) Filed: Feb. 14, 2000

(51) Int. Cl.[7] ..... B66C 23/62
(52) U.S. Cl. ..... 212/301; 212/175; 212/179
(58) Field of Search ..... 212/178, 195, 212/196, 197, 198, 253, 301, 312, 175

(56) References Cited

U.S. PATENT DOCUMENTS

| | | | | |
|---|---|---|---|---|
| 968,813 | * | 8/1910 | Taylor | 212/312 |
| 1,128,151 | * | 2/1915 | King et al. | 212/301 |
| 2,139,960 | * | 12/1938 | Kauffman | 212/301 |
| 2,513,726 | * | 7/1950 | Huston | 212/252 |
| 3,955,684 | * | 5/1976 | Novotny | 212/178 |
| 4,000,784 | * | 1/1977 | Morrow et al. | 180/9.48 |
| 4,053,060 | * | 10/1977 | Wilson | 212/301 |
| 4,196,816 | * | 4/1980 | Dvorsky et al. | 212/49 |
| 4,316,548 | | 2/1982 | Helm et al. . | |
| 4,336,889 | * | 6/1982 | McGrew | 212/178 |
| 4,358,021 | * | 11/1982 | Helm et al. | 212/195 |
| 4,381,060 | | 4/1983 | Morrow et al. . | |
| 4,382,519 | | 5/1983 | Beduhn et al. . | |
| 4,387,814 | | 6/1983 | Beduhn et al. . | |
| 4,402,414 | * | 9/1983 | Nitto | 212/253 |
| 4,483,448 | * | 11/1984 | Wittman et al. | 212/189 |
| 4,579,234 | | 4/1986 | Delago et al. . | |
| 5,522,515 | * | 6/1996 | Pech et al. | 212/253 |
| 5,941,401 | | 8/1999 | Petzold et al. . | |

FOREIGN PATENT DOCUMENTS

| | | | | |
|---|---|---|---|---|
| 1781161 | * | 12/1992 | (SU) | 212/195 |

* cited by examiner

*Primary Examiner*—Thomas J. Brahan
(74) *Attorney, Agent, or Firm*—Keeling Law Firm

(57) ABSTRACT

A system of multiple concentric annular support pedestal rings for providing load and counterweight support for a ring supported crane. The pedestal rings are fabricated from uniform sections of steel, which are mated at preferably triangular shaped ends. A top rail is secured on the ring segments to complete the pedestal ring. At least two rings support the crane through rocker beam assembly structures for powered and idler rollers, providing additional strength and stability to the crane through the distribution of weight forces down through a larger support footprint. Additional stability is also provided by substantially increasing the weight of counterweight that can be utilized. Weight distribution from the boom and mast is enhanced with an inventive boom foot carrier, that distributes the weight of the boom and/or mast through multiple concentric rings. Weight distribution from the counterweight is similarly distributed through the inventive counterweight carrier.

9 Claims, 6 Drawing Sheets

MULTIPLE PEDESTAL RING FOR RINGER CRANE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

This invention relates to a system of annular circular pedestal rings for heavy cranes and lifting devices. Specifically, the invention describes a system of multiple concentric pedestal rings to provide increased strength and stability for a ring supported crane.

2. Related Art

For purposes of clarity, it is understood that the term "ring", unless otherwise specified, is used in this description and specification to refer to ground supported annular pedestal support rings as used in heavy cranes and similar lifting devices. These rings are supported by a plurality of pedestals, which transfer weight loads to the ground.

Ring supported lift cranes have been known in the field of heavy lifting for many years. Many such cranes are modified mobile track crawler cranes, while others are site erected fixed cranes or barge mounted marine heavy lift cranes. All types of ring supported lift cranes are based on the same physical principal of weight transfer of the boom, load, crane upper and lower works and counterweight to the ring footprint.

Typically, the crane upper works and lower works fit within the ring, with the lower works connected to the ring through a roller path for rotation. The upper works typically include the cab, engine, load lifting power transmission and winch drums. Attached to one end of the upper works is a boom foot carrier supporting the pivotally mounted boom and/or mast. At the other end of the upper works is the counterweight carrier. The upper and lower works are concentric with the ring, and rotate with respect to the lower works about a generally vertical swing axis. The weight of the counterweights, boom, mast and load is supported by rollers mounted to the upper works. These rollers are supported by and move over the ring. The ring is supported by a plurality of pedestals, which may be integral and attached to the ring, that transfer the total weight to the ground.

Prior art cranes utilize a single ring. Rings are traditionally constructed in segments, typically eight, to form together into a complete ring by pinned connections.

These segments mate to form one ring diameter to form a curved beam. A rail formed from a relatively thin steel plate cut to the radius of the ring is then placed on top of the ring to form a smooth surface on which the rollers move.

The amount of weight that can be supported by the ring is dependent on the strength of the curved beam, strength of the pedestals and the number and placement of pedestals.

A significant limiting factor is the number and placement of the pedestals. Additional pedestals afford additional means of transferring weight load to the ground, reducing bending moments in the ring. These additional pedestals are limited by spatial constraints below the ring, where a limited amount of room is available. Further, the addition of pedestals does not decrease the direct vertical load force placed on a pedestal by the crane.

Another significant limiting factor of the load capacity of the ring system is the strength of the curved beam. To increase the strength of the beam, a new set of heavier segments must be used. These segments are expensive, difficult to maneuver, and are typically unique to a particular crane design.

It would therefore be a new and useful improvement of the prior art for a pedestal ring system of a heavy crane or lifting device to not be limited in capacity by the strength of its rollers, roller path, ring system and pedestals, but for additional load capacity to be provided by distributing these loads through to multiple concentric rings.

BRIEF SUMMARY OF THE INVENTION

Accordingly, the objectives of this invention are to provide, inter alia, a new and improved pedestal ring system for heavy cranes and lifting devices that:

- provides additional load distribution and load spreading capabilities for extra heavy boom foot loads and/or counterweight loads;
- uses ring segments that are uniform in size and are lightweight; and/or
- uses interchangeable ring segments that can be configured in different ring diameters.

These objectives are addressed by the structure and use of the inventive pedestal rings system. Specifically, a system of multiple concentric pedestal rings provides support of the crane and its load by distributing the weight of the crane, its counterweight and load down through at least two concentric rings supported by a plurality of pedestals. This arrangement provides a large footprint to resist crane tipping, and provides improved distribution and weight transfer through the footprint.

Other objects of the invention will become apparent from time to time throughout the specification hereinafter disclosed.

DETAILED DESCRIPTION OF THE INVENTION

The present invention is described as multiple ring and crane assembly 10, which includes concentric multiple pedestal rings 15 and multiple ring crane means of rotatable support 189.

Figure 1:
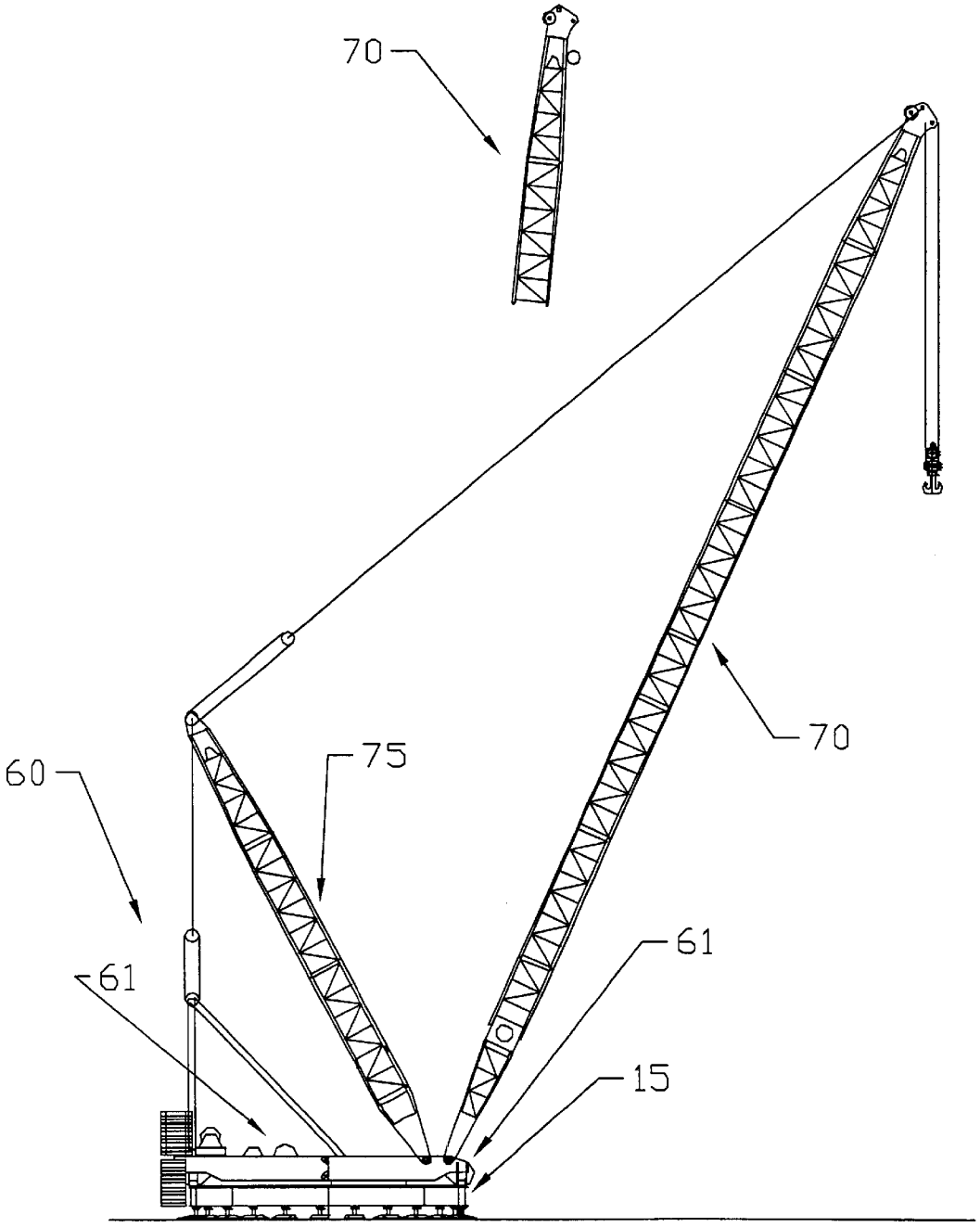
FIG. 1 depicts a prior art single ring crane.
Figure 2:
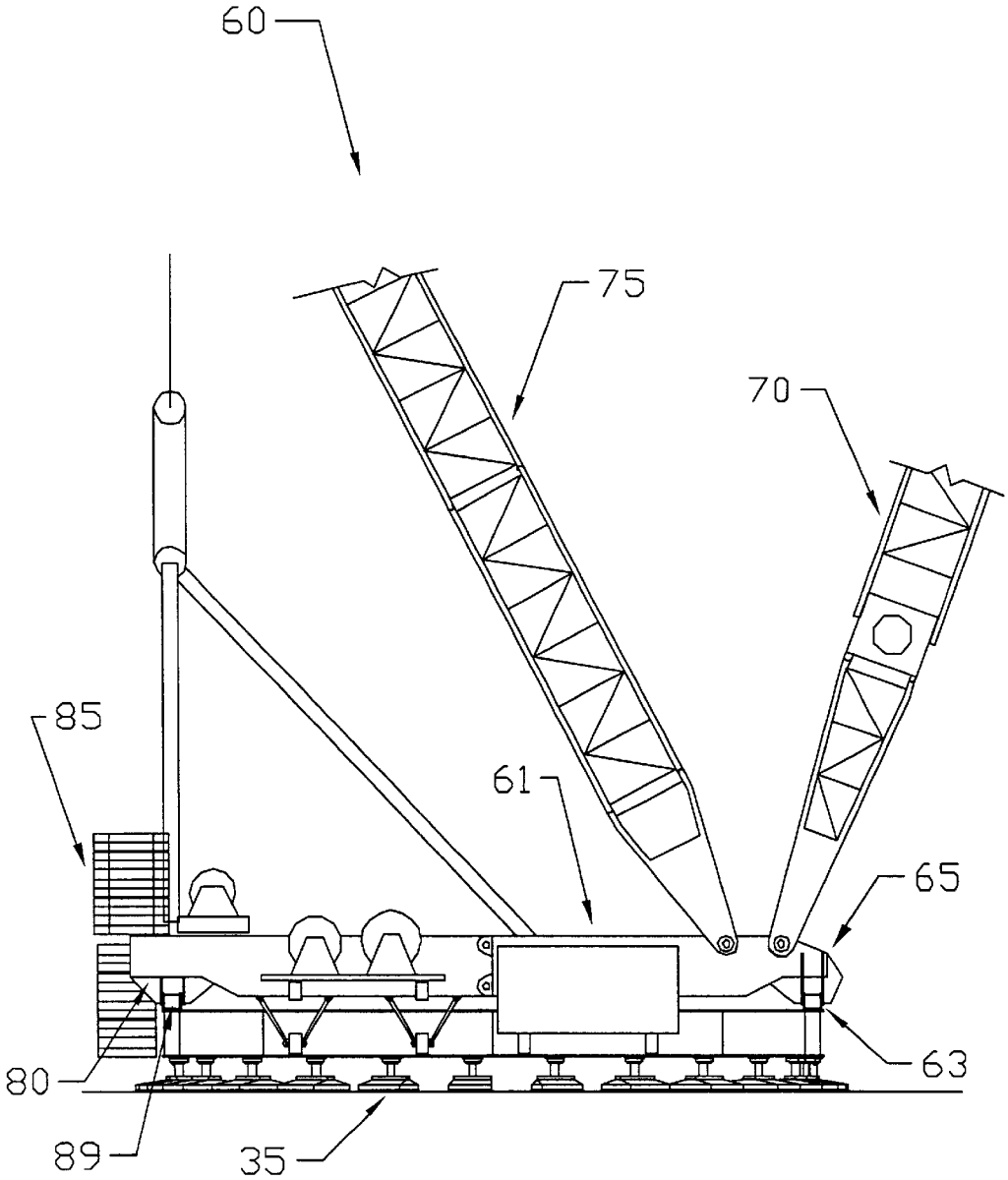
FIG. 2 depicts a close view of the base of a prior art ring crane.

FIG. 1 depicts prior art crane 60 having upper works 61 rotatably mounted on pedestal ring 15. As shown in greater detail in FIG. 2, upper works 65 includes counterweight carrier 80 and boom foot carrier 65 located at opposing ends of upper works 65. Counterweight carrier 80 supports counterweight 85, which provides counterbalance to the uplift forces generated by mast 75. Boom foot carrier 65 supports mast 75, boom 70 and the forces imposed on mast 75 and boom 70 by the suspended load (not shown).

Upper works 61 and pedestal ring 15 are connected such that upper works 61 rotates around pedestal ring 15 when means for rotation 63 are engaged. Upper works 61 further includes means for rotatable support 89, which includes powered rollers 90 and typically idler rollers 95. Means for rotatable support 89 are mounted to upper works 61, providing additional load support (in addition to crawler tracks, where utilized) to distribute downward forces of crane 60 and its load across a wider footprint that is offered by single pedestal ring 15 and its support pedestals 35. This load distribution is directed through powered rollers 90 and idler rollers 95 resting on single pedestal ring 15.

Traditionally, single pedestal ring 15 as used in the prior art is constructed using (typically) eight segments of curved beams that mate together to form one ring diameter. Top rail 40 is mounted (either fixed or removable) on top of the segments of curved beams to form a smooth top surface and rail for guiding the rollers. Upper works 61 include means for rotation 63, typically powered rollers 90 driven on top of top rail 40.

To provide additional support and load distribution down to the ground footprint, powered rollers 90 and idler rollers 95 roll along single pedestal ring 15. Power is provided to powered rollers 90 typically by hydraulic motors dedicated to each powered roller.

Figure 3:
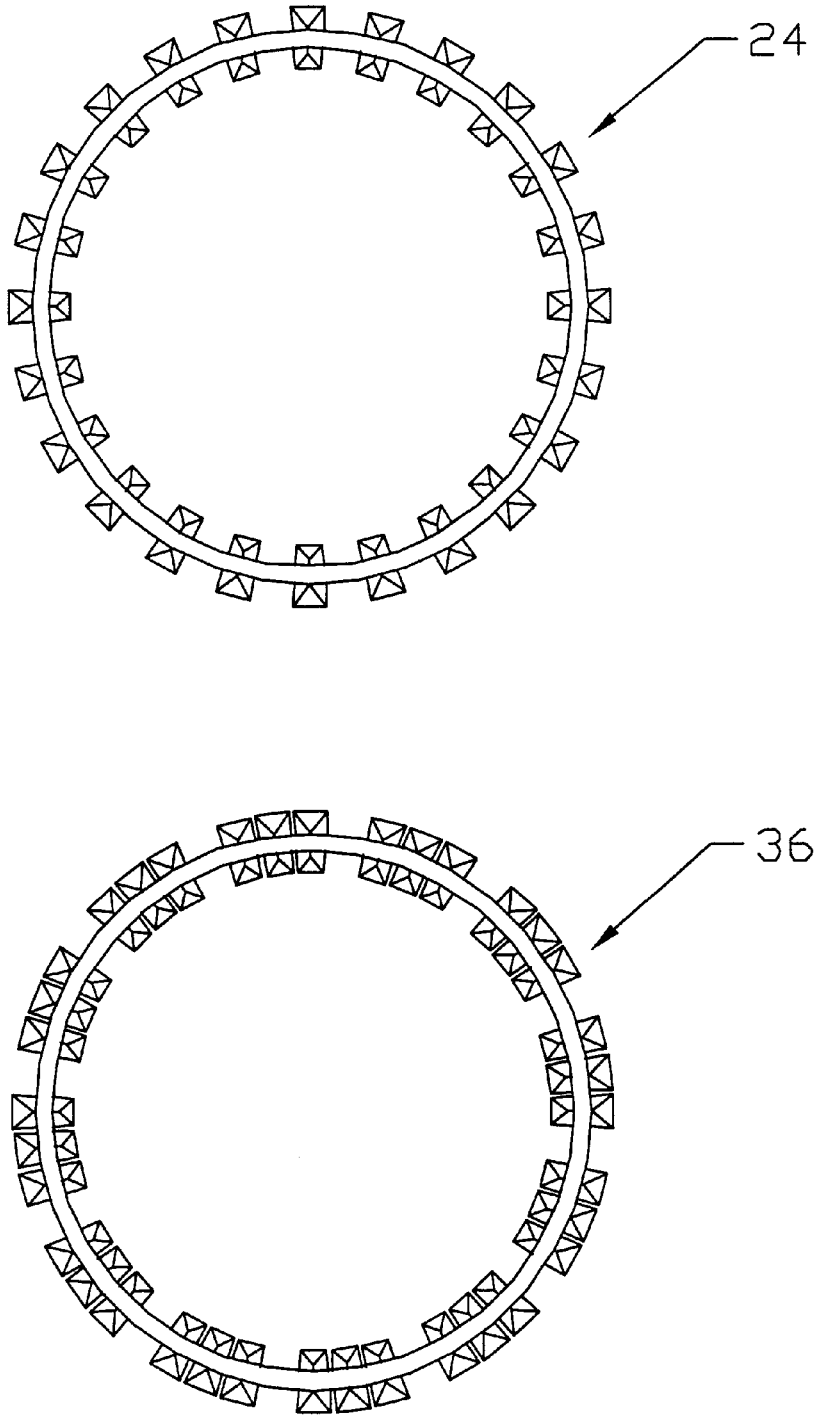
FIG. 3 depicts prior art rings using 24 and 36 pedestals.

When additional ground surface area and pedestal support was required in the prior art, additional pedestals were provided below the single pedestal ring 15, as depicted in FIG. 3. Moderate pedestal ring 24 is upgraded to heavy pedestal ring 36 by simply placing more pedestals supporting pedestal ring 15. While this provides additional total support, it provides only minimal additional weight distribution away from a particular support pedestal 35. Further, the addition of support pedestals 35 is limited by the physical space under pedestal ring 15. In addition, the total capacity of boom foot carrier 65 and pedestal ring 15 is limited in the prior art due to the limitations of the strength of single pedestal ring 15 and boom foot carrier 65.

Figure 5:
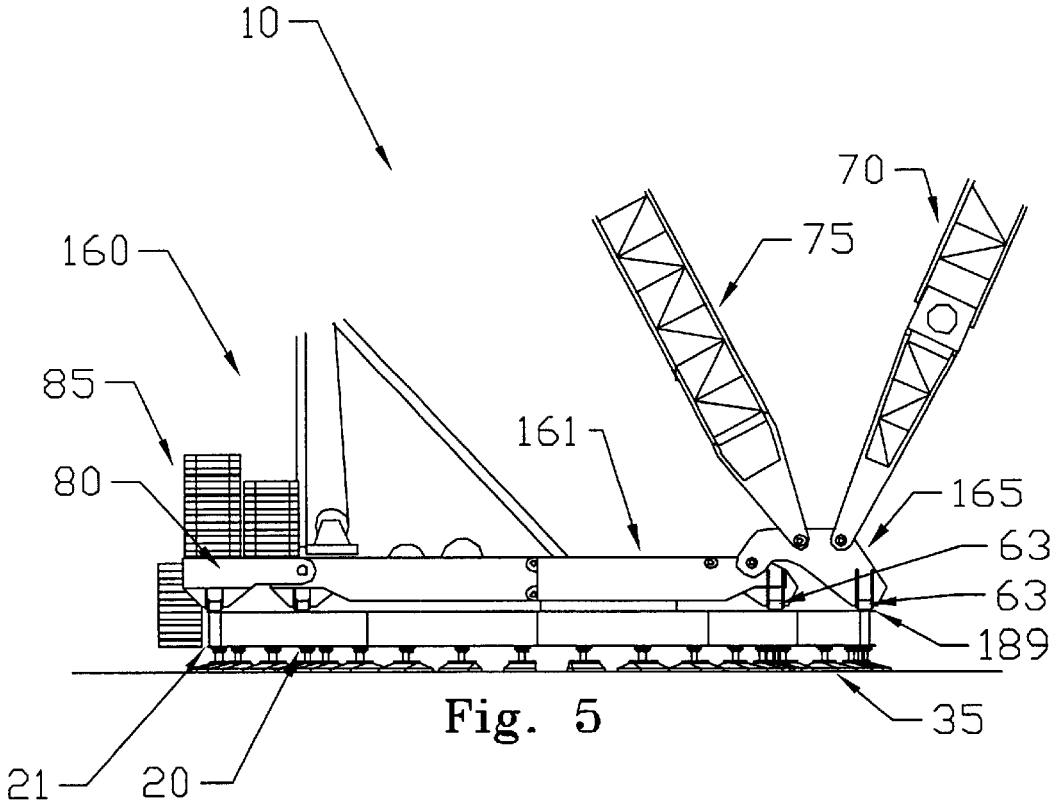
FIG. 5 depicts the inventive multiple rings with a crane.
Figure 4:
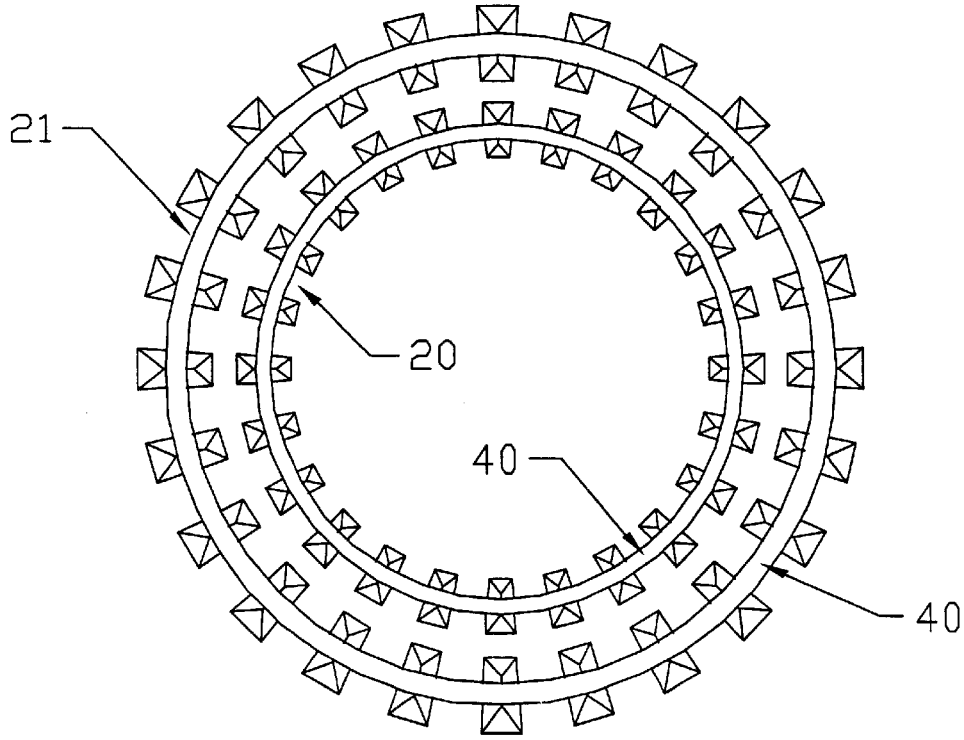
FIG. 4 depicts the inventive multiple rings.

The inventive multiple ring and crane assembly 10 utilizes beam load distribution through double ring boom foot carrier 165, as depicted in FIG. 5 through to the multiple concentric pedestal rings, outer pedestal ring 21 and inner pedestal ring 20, providing much higher crane capacity than found in prior art ringer cranes. As depicted in FIG. 4, at least two concentric pedestal rings 15 provide support to multiple ring crane 160 depicted in FIG. 5. The roller assembly comprising means of rotatable support 89 roll across the outer pedestal ring 21, and the subsequent inner roller assembly(s) comprising inner rotatable supports 89 rolls across the subsequent inner pedestal rings 20. This further distributes the weight of crane 60 by the beam distribution effect of distributing the load across outer pedestal ring 21 and inner pedestal ring(s) 20 via the beam effect of the structure of upper works 61. Thus the outer roller assembly rolls across outer pedestal ring 21, while each subsequent inner ring assembly rolls across its own inner pedestal ring 20.

While the preferred embodiment uses two concentric pedestal rings 15, alternatively more than two rings can be used in the inventive system. Multiple ring crane upper works 161 is positioned on top of inner pedestal ring 20, similar to the prior art as described above. When the lift conditions require additional capacities in excess of the strength capabilities of the single ring crane, outer pedestal ring 21 is assembled around inner pedestal ring 20. Double ring boom foot carrier 165 and double ring counterweight carrier 180 are mounted on top of outer pedestal ring 21 and multiple ring crane upper works 161. Boom 70, mast 75 and counterweight 85 are then assembled on top of double ring boom foot carrier 165 and double ring counterweight carrier 180, respectively. The downward load force exerted by multiple ring crane 160 and its suspended load is directed through boom 70 and mast 75, and is distributed through double ring boom foot carrier 165 to outer pedestal ring 21 and inner pedestal ring 20 and then down through their support pedestals 35 to the support (ground if on land; deck if marine) footprint. A similar load distribution is utilized for counterweight 85. This allows significant additional counterweight to be utilized by crane 60 to further increase stability against tipping. Double ring counterweight carrier 180 is capable of rotating around inner pedestal ring 20 and outer ring 21 with the full load of counterweight 85 distributed through inner pedestal ring 20 and outer pedestal ring 21. Thus, if there is no suspended load on the hook, inner pedestal ring 20 and outer pedestal ring 21 support all of the force of counterweight 85, and multiple ring crane upper works 161 is capable of rotating with counterweight 85. As additional load is placed on the hook, up to the maximum capacity of crane 60, counterweight 85 reactions to the rings are diminished. By distributing the load over inner pedestal ring 20 and outer pedestal ring 21 and their support pedestals 35, the load is transmitted to the supporting base (ground or marine deck) over a larger footprint, providing greater support and stability to crane 60.

Multiple ring and crane assembly 10 provides rotational forces via powered rollers 90 rolling across inner pedestal ring 20 as well as the outer pedestal ring 21.

Figure 6:
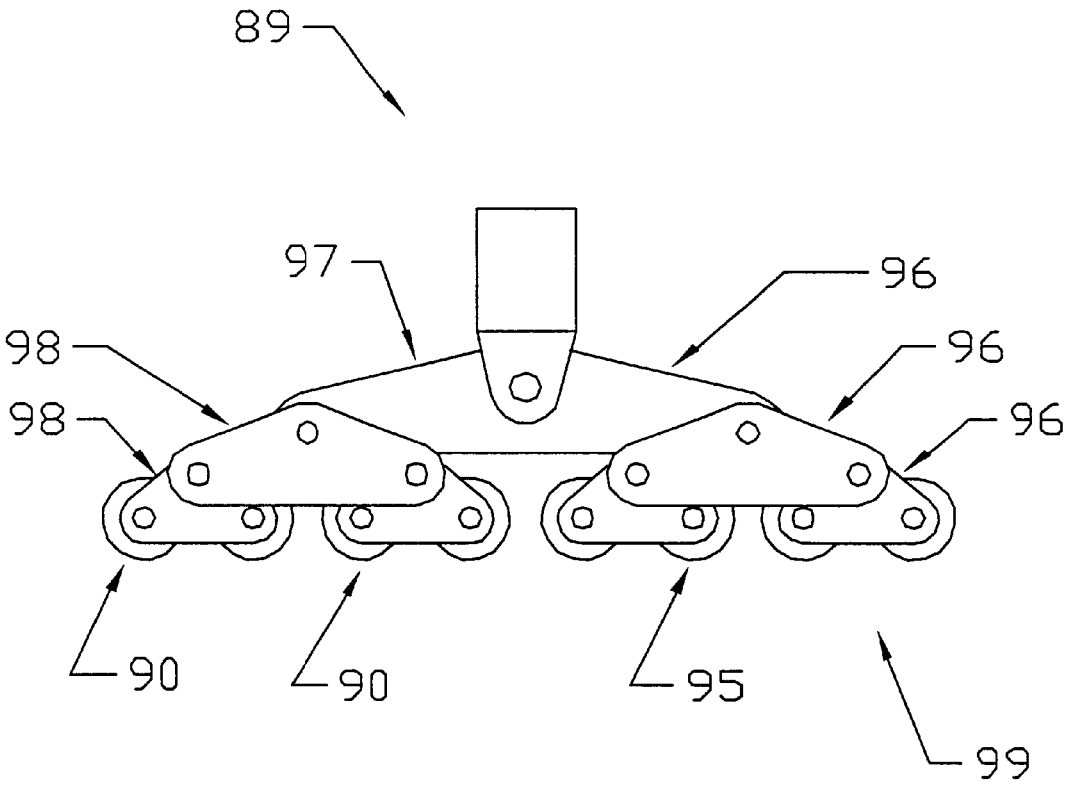
FIG. 6 depicts the rocker beam assembly used as a preferred means of rotatable support in the inventive system.

FIG. 6 depicts the preferred embodiment of the support structure for both powered rollers 90 and idler rollers 95. Multiple ring crane upper works 161 connects to its first rocker beam 97 for inner ring 20, and double ring boom foot carrier 165 connects to its first rocker beam 97 for outer ring 21. These forces are distributed across first rocker beam 97, down through subsequent rocker beams 98, through the rollers (powered rollers 90 and idler rollers 95), through inner pedestal ring 20 and outer pedestal ring 21, through support pedestals 35 and down to the stable supporting surface (ground, marine deck, or similar structure). Rocker beam assembly 99 includes multiple pinning connections that allow for articulation of rocker beams 96 to provide oscillation where required to ensure that loads are distributed evenly even where there is some differential deflection between inner pedestal ring 20 and outer pedestal ring 24 or relative rotation between these rings. While rocker beam assembly 99 is shown in the preferred embodiment in FIG. 6 with first rocker beam 97 and two levels of subsequent rocker beams 98, alternative embodiments can use more than two levels of subsequent rocker beams 98 to distribute larger forces. Alternatively, hydraulic means may be utilized to distribute the loads.

Figure 7:
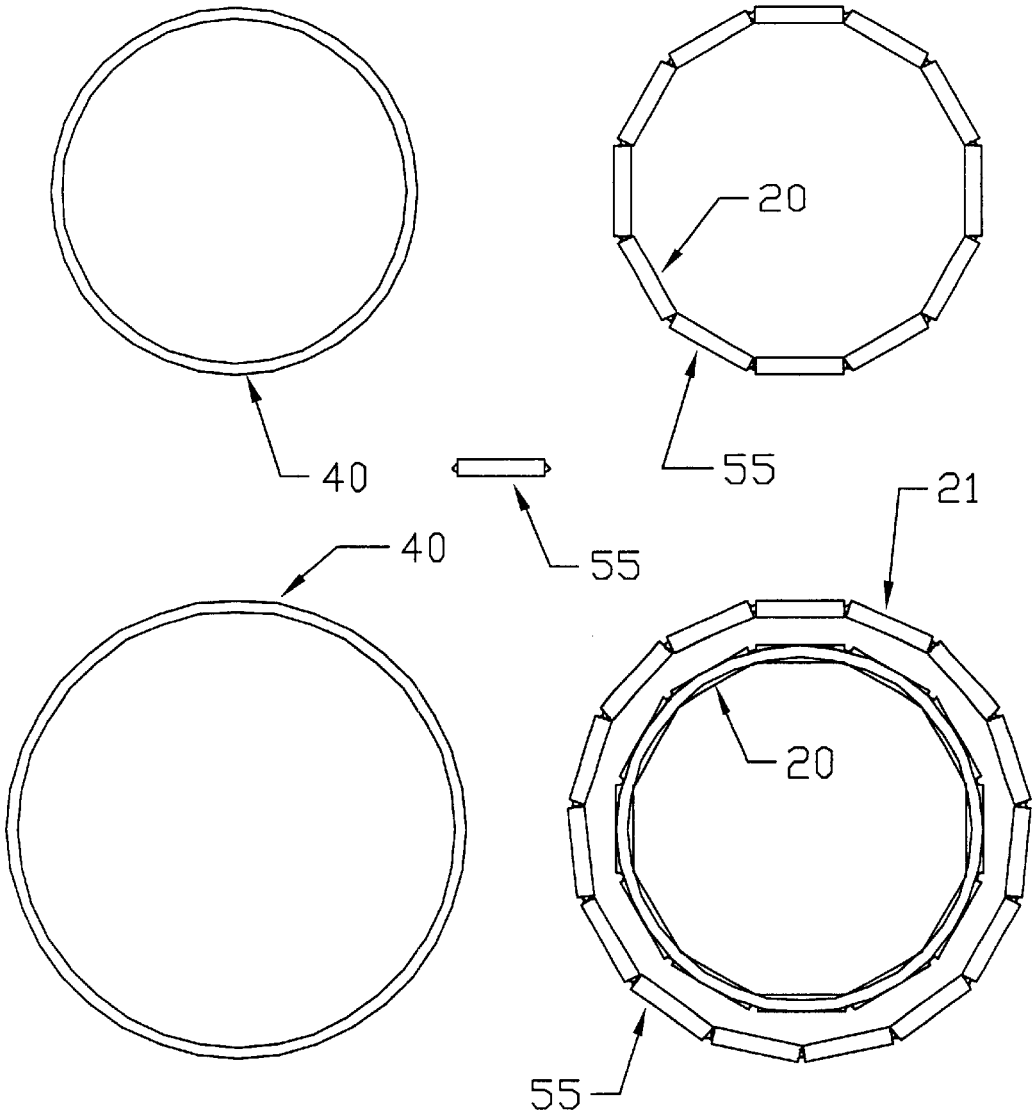
FIG. 7 depicts the inventive ring segment, and use in single and multiple concentric ring configurations.

FIG. 7 depicts the method of constructing inner pedestal ring 20 and outer pedestal ring 21. In the prior art, ring segments were specifically sized and shaped to form a specific diameter pedestal ring 15 with pre-engineered strength. The inventive pedestal ring 15 uses uniform sized ring segments 55 to describe any diameter compatible with the diameter of a top rail 40, which is superposed on top of the ring segments 55. Ring segment 55 is constructed preferably of heavy gauge I-beams. These I-beams are not curved, as in prior art, but mate together by triangular end shapes that roughly match together. The continuous faces of the ends of ring segments 55 are pinned together to form a single ring, which is further supported laterally by top rail 40. Alternatively, ring segments 55 are fabricated as in the prior art, such that each required diameter is preformed for inner pedestal ring 20 and outer pedestal ring 21. Top rail 40 may be an integral part of the ring segments 55 or may be removable, depending on the application.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A multiple outer ring assembly for supporting a crane load and counterweight, said multiple outer ring assembly comprising:

a first outer ring and at least one second outer ring;

said first outer ring and each said at least one second outer ring comprising a plurality of ring segments, a top rail and a plurality of support pedestals;

said first outer ring and each said at least one second outer ring having different diameters;

said first outer ring and each said at least one second outer ring being separate and noncontiguous;

said first outer ring and each said at least one second outer ring being concentric;

said plurality of ring segments being connected to form a ring diameter corresponding to a diameter of each different said top rail;

said plurality of support pedestals positioned on a stable surface and supporting said plurality of ring segments;

said ring segments being of uniform and standard size and shape and interchangeable between said first outer ring and each said at least one second outer ring; and means for transferring a vertical load across both said first outer ring and said at least one second outer ring.

2. The multiple outer ring assembly as in claim 1, further comprising:

each of said plurality of ring segments having a first end and a second end; and said ring segment first end and said ring segment second end each having a chamfered shape.

3. The multiple outer ring assembly as in claim 1, further comprising:

each of said plurality of ring segments having straight longitudinal sides.

4. A multiple outer rings and crane assembly for increasing a crane's lifting capacity comprising:

said multiple outer rings comprising a first outer ring and at least one second outer ring;

said first outer ring and each said at least one second outer ring comprising a plurality of ring segments, a top rail and a plurality of support pedestals;

said first outer ring and each said at least one second outer ring having different diameters;

said first outer ring and each said at least one second outer ring being separate and noncontiguous;

said plurality of ring segments being connected to form a ring diameter corresponding to a diameter of each different said top rail;

said plurality of support pedestals positioned on a stable surface and supporting said plurality of ring segments;

said ring segments being of uniform size and shape for said first outer ring and each said at least one second outer ring;

means for transferring a vertical load across both said first outer ring and said at least one second outer ring;

said crane comprising an upper works rotatably mounted on said multiple outer rings;

i) said upper works comprising a load lifting means and a means of rotatable support;

said means of rotatable support including an inner roller assembly and at least one outer roller assembly; and ii) said upper works comprising a means of rotation.

5. The multiple outer rings and crane assembly as in claim 4, further comprising:

said upper works further comprising a boom foot carrier and a counterweight carrier oriented on opposite ends of said upper works;

said boom foot carrier supporting a pivotally mounted boom; and said counterweight carrier supporting a counterweight.

6. The multiple outer rings and crane assembly as in claim 4, further comprising:

said means of rotatable support comprising at least one powered roller and at least one idler roller.

7. The multiple outer rings and crane assembly as in claim 4, further comprising:

said means of rotatable support comprising a rocker beam connecting said lower works and a plurality of first rocker beams;

each of said first plurality of rocker beams being connected to a plurality of second rocker beams;

each of said plurality of second rocker beams being connected to a plurality of third rocker beams;

each of said plurality of third rocker beams being connected to at least two rollers.

8. The multiple outer rings and crane assembly as in claim 7, said at least two rollers comprising at least one idler roller and at least one powered roller.

9. A method of increasing the strength and stability of a ring supported crane, comprising:

providing multiple concentric non-contiguous outer support rings;

assembling said multiple outer support rings from a plurality of uniform and standard sized and shaped ring segments;

transferring a vertical load from boom and mast reactions and from counterweight loads across both said first outer ring and said at least one second outer ring;

using uniform and standard sized and shaped said plurality of ring segments having straight longitudinal sides; each of said plurality of ring segments having a first end and a second end; and said ring segment first end and said ring segment second end each having a chamfered shape.

* * * * *